US008291667B2

(12) United States Patent
Jahn et al.

(10) Patent No.: US 8,291,667 B2
(45) Date of Patent: Oct. 23, 2012

(54) ACCESSIBLE CONCEALED SUSPENDED CEILING SYSTEM

(75) Inventors: Peter G. Jahn, Palos Park, IL (US); Mark A. Fladeland, Bolingbrook, IL (US)

(73) Assignee: Chicago Metallic Corporation, Chicago, IL (US)

( * ) Notice: Subject to any disclaimer, the term of this patent is extended or adjusted under 35 U.S.C. 154(b) by 0 days.

(21) Appl. No.: 13/165,976

(22) Filed: Jun. 22, 2011

(65) Prior Publication Data

US 2011/0314761 A1 Dec. 29, 2011

Related U.S. Application Data

(60) Provisional application No. 61/358,155, filed on Jun. 24, 2010.

(51) Int. Cl.
*E04B 9/00* (2006.01)

(52) U.S. Cl. ..... 52/506.07; 52/506.09; 52/774; 52/777; 52/483.1

(58) Field of Classification Search .. 52/506.06–506.09, 52/510, 483.1, 762, 763, 774, 775, 777–779
See application file for complete search history.

(56) References Cited

U.S. PATENT DOCUMENTS

| | | | | |
|---|---|---|---|---|
| 3,488,908 | A | 7/1967 | Jahn | |
| 3,548,556 | A * | 12/1970 | Vermeulen | 52/506.06 |
| 3,589,086 | A | 6/1971 | Schilling | |
| 3,645,051 | A | 2/1972 | Kolesar | |
| 3,900,997 | A | 8/1975 | Ollinger | |
| 4,157,000 | A | 6/1979 | Sutter | |
| 4,463,537 | A | 8/1984 | Rodriquez | |
| 4,580,382 | A | 4/1986 | Judkins | |
| 4,646,506 | A * | 3/1987 | Slapsys | 52/772 |
| 4,696,142 | A | 9/1987 | Mieyal | |
| 4,760,677 | A | 8/1988 | Nassof | |
| 4,884,383 | A | 12/1989 | Rijnders | |
| 5,311,719 | A * | 5/1994 | Jahn | 52/506.09 |
| 6,108,994 | A | 8/2000 | Bodine | |
| 6,260,325 | B1 | 7/2001 | Wendt | |
| 7,634,881 | B2 * | 12/2009 | Ahren et al. | 52/506.06 |
| 2010/0064617 | A1 | 3/2010 | Kelley | |
| 2010/0269444 | A1 | 10/2010 | Gulbrandsen | |

* cited by examiner

*Primary Examiner* — Brian Glessner
*Assistant Examiner* — Adam Barlow
(74) *Attorney, Agent, or Firm* — Cook Alex Ltd.

(57) ABSTRACT

A suspended ceiling system is provided comprising at least first and second parallel inverted tee-runners. Each tee-runner comprises a horizontal flange and a vertical web, with the vertical web having at least two spaced openings therein. At least one ceiling panel is associated with the parallel tee-runners. The ceiling panel has opposed side walls and opposed end walls, with a pair of first tabs formed at one end of the ceiling panel and a pair of second tabs formed at the opposite end of the panel. The first tabs are relatively longer than the second tabs and have a length sufficient so that each first tab extends through one of the spaced openings in the web of the first inverted tee-runner and rests on the flange of the first tee-runner, with the second tabs being supported by the flange of the second tee-runner.

16 Claims, 4 Drawing Sheets

ACCESSIBLE CONCEALED SUSPENDED CEILING SYSTEM

CROSS REFERENCE TO RELATED APPLICATION

This application claims the benefit of the filing date of U.S. Provisional Application Ser. No. 61/358,155, filed Jun. 24, 2010, the entire contents of which are incorporated by reference herein.

BACKGROUND

The present disclosure is directed to an accessible concealed ceiling system and, more particularly, to a metal ceiling panel and grid member used in the system.

It is known to provide a suspended ceiling system comprising a grid of inverted tee-runners having outwardly-extending flanges that support the ceiling panels. For aesthetic reasons, it may be desirable to conceal the grid system, and this has been done by having the ceiling panels formed with a recess at two of the opposite ends. This provides for the flange of the tee-runner to be received in the recess with the edges of the exposed surface of the panel being positioned in close proximity to the edges of the adjacent panels so that the grid system is substantially concealed by the installed panels. See, e.g., U.S. Pat. No. 5,311,719, having a common assignee as the present application.

The present disclosure presents a concealed ceiling panel and grid system that provides for more consistent alignment of the panels, thus insuring consistent spacing of the edges between adjacent panels, and, consequently, an improved appearance.

SUMMARY OF THE DISCLOSURE

In one aspect of the present disclosure, a suspended ceiling system is provided comprising at least first and second parallel inverted tee-runners. Each tee-runner comprises a horizontal flange and a vertical web, with the vertical web having at least two spaced openings therein. At least one ceiling panel is associated with the parallel tee-runners. The ceiling panel has opposed side walls and opposed end walls, with a pair of first tabs formed at one end of the ceiling panel and a pair of second tabs formed at the opposite end of the panel. The first tabs are relatively longer than the second tabs and have a length sufficient so that each first tab extends through one of the spaced openings in the web of the first inverted tee-runner and rests on the flange of the first tee-runner, with the second tabs being supported by the flange of the second tee-runner.

In another aspect of the disclosure, the first and second tabs of the ceiling panel are formed in the side walls of the panel, and the side walls are relieved adjacent the first tabs.

In a further aspect of the disclosure, the openings in the web of the tee-runners and the first tabs of the ceiling panel are complimentarily-shaped so as to limit the lateral positioning of the panel relative to the tee-runner, and to provide side-to-side alignment of adjacent panels.

In a still further aspect of the disclosure, one or both of the pairs of the first tabs and the second tabs of the ceiling panel are formed with a shoulder for engaging an edge of the flange of the associated tee-runner to provide end-to-end alignment of adjacent panels.

In a further aspect of the disclosure, one of the end walls of the ceiling panel is formed with an outwardly-extending flange, while the other end wall is relieved to receive the outwardly-extending flange of an adjacent panel.

In a still further aspect of the disclosure, one of the side walls and one of the end walls of each ceiling panel is provided with a resilient material for inhibiting vibration between adjacent panels.

Other aspects of the disclosure will become apparent upon reference to the following detailed description and accompanying drawings.

DETAILED DESCRIPTION

Figure 1:
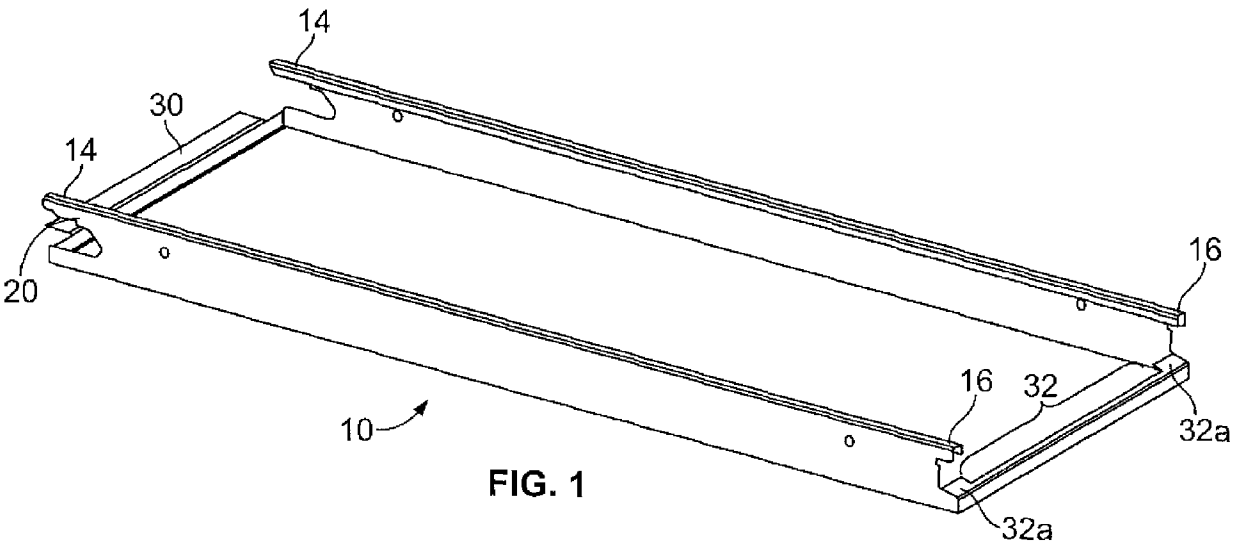
FIG. 1 is a perspective view of an individual panel forming a part of the ceiling system of the present application.
Figure 2:
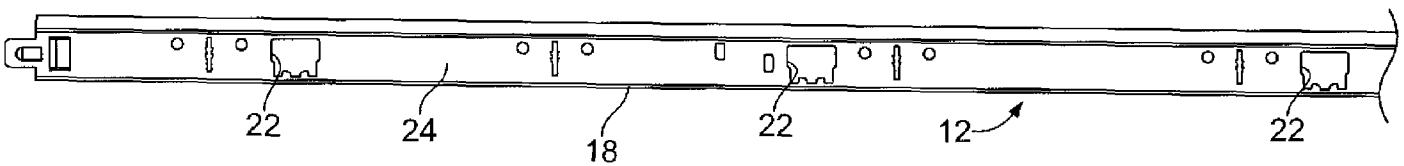
FIG. 2 is a side view of a main runner forming part of the ceiling system of the present application.
Figure 3:
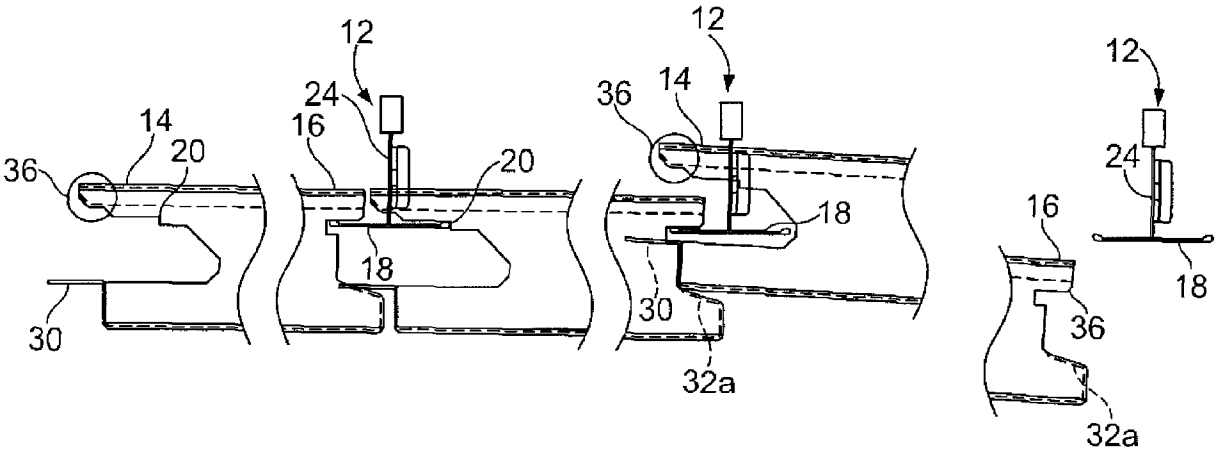
FIG. 3 is a side view of the system of the present application showing the installation of a panel into the system.
Figure 4:
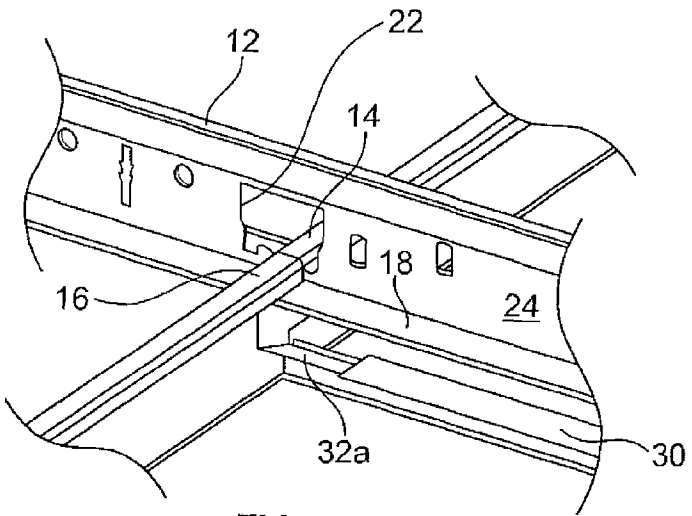
FIG. 4 is an enlarged perspective view showing two panels end-to-end supported on a common main runner.

Referring to the drawings, there is seen a perspective view of a hook-in ceiling panel according to the present disclosure, generally designated 10 (FIG. 1), and a side view of a tee or main runner for use with the ceiling panel, generally designated 12 (FIG. 2). The panel 10 is formed from a single sheet of metal, with the edges folded upwardly along the sides and ends to form side walls and end walls that define the exposed face of the panel. The ceiling panel 10 has a pair of elongated tabs 14 formed in the side walls at the corners of one end of the panel, and shorter tabs 16 formed in the side walls at the corners of the other end. As seen in FIGS. 3 and 4 of the drawings, when positioned between adjacent tee-runners, the longer tabs 14 rest on the flange 18 of one tee-runner 12, while the shorter tabs 16 rest on the flange 18 of an adjacent tee-runner 12, thus supporting the panel 10.

In order to precisely seat the ceiling panel with respect to the flange of its associated main runner, and thus ensure proper end-to-end alignment of the panels, the elongated tabs 14 are relieved to form shoulders or notches 20 that engage the edge of the flange 18. While in the illustrated embodiment, the elongated tabs 14 are shown having the notches or shoulders, the shorter tabs 16 could also be formed with such notches or shoulders, or both tabs 14 and 16 could be formed with notches. As best seen in FIG. 3, the ends 36 of the tabs 14, 16 may also be rounded or tapered to facilitate their installation into the ceiling system.

In the assembled ceiling system of the present disclosure, the elongated tabs 14 of the ceiling panels extend through cutouts 22 in the vertical web 24 of the tee-runners 12. As is readily understood, a series of such precisely-spaced cutouts 22 is provided along the length of the main runners 12 of an assembled grid so as to permit use of a plurality of ceiling panels 10 with each main runner. While a single cutout 22 for receiving the elongated tabs of adjacent ceiling panels is shown in the drawings, alternatively, two cutouts or a divided cutout could be provided, with one opening for the elongated tabs 14 of a first ceiling panel and the other for the elongated tab 14 of the adjacent panel. For ease of installation of the tabs 14 into the cutouts 22, the width of the cutouts 22 is wider at the top than at the bottom, where the tabs are seated.

Figure 5:
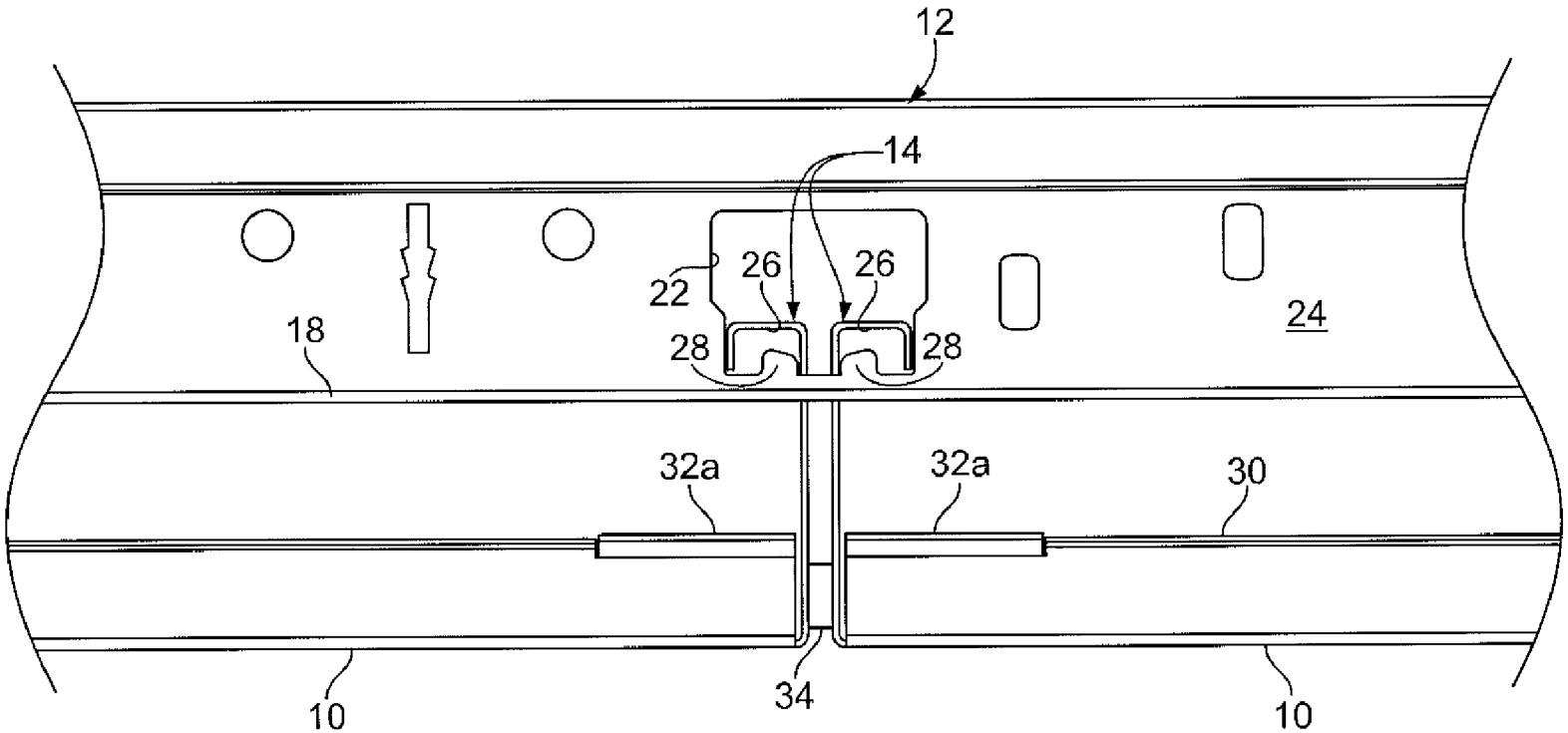
FIG. 5 is an end view showing two panels side-by-side supported by a common main runner.

Referring to FIG. 5 of the drawings, there is seen an enlarged view of the elongated tabs 14 of adjacent ceiling panels received in the cutout 22 in the vertical web 24 of the main runner. In order to more precisely locate the panels side-to-side in the assembled ceiling, the elongated tabs 14 and cutouts 22 are provided with complementarily-shaped, interfitting projections and recesses. In the illustrated embodiment the elongated tabs 14 are formed to have an inverted U-shaped cross section so as to define a recess or slot 26, while the cutouts 22 are formed with projections 28 sized to be received in the slots 26. When the panel is installed, one edge of the vertical leg of the slot 26 for each elongated tab 14 abuts an edge of the projection 28 in the precision cutout 22, while the other vertical leg of the slot 26 engages a side wall in the vertical cutout, thus precisely locating adjacent panels side-to-side.

Figure 6A:
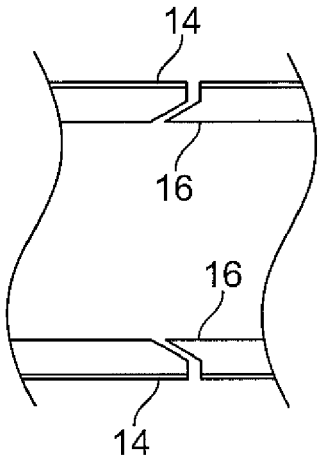
FIGS. 6*a*, 6*b* and 6*c* are fragmentary top views showing the complementarily-shaped tabs of adjacent panels.
Figure 6B:
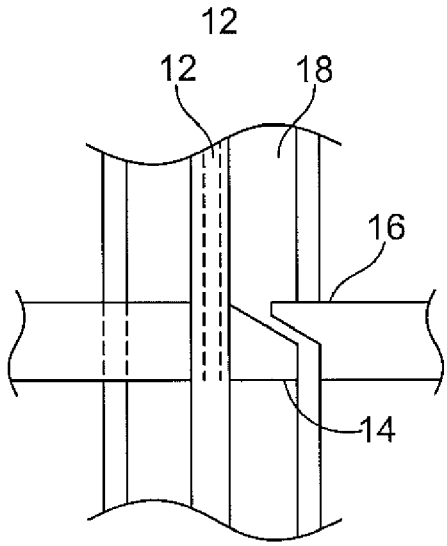
Figure 6C:
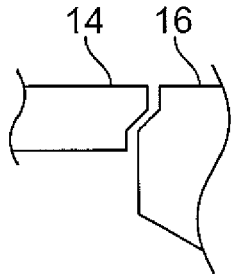

As seen in FIG. 1, the ceiling panel 10 is also provided with a flange 30 extending from the end wall between the elongated tabs 14, while the opposite end wall of the ceiling panel has a cutout or cutaway portion 32 bounded by tabs 32*a*. As best seen in FIG. 4, the cutaway portion 32 receives or seats the flange 30 of an adjacent panel, with the flange 30 and tabs 32*a* thus cooperating to provide additional side-to-side alignment of the adjacent panels. Alternatively, or additionally, side-to-side alignment of the panels may be provided by making the ends of the tabs 14, 16 complementarily-shaped, as shown in FIGS. 6*a*, 6*b*, and 6*c*, so that they interlock upon installation of the panels 10 in the grid.

In order to suppress vibration of the panels, and any resultant rattling noise, at least one side and one end of each panel may be provided with a resilient gasket. As seen in FIG. 5, the gasket may be in the form of a foam strip 34. However, any resilient material secured between the edges of adjacent panels will suffice.

The installation of a ceiling panel into the ceiling system is shown in FIG. 3. As seen in FIG. 3, the upwardly extending side wall of the panel 10 adjacent the elongated tab 14 is cut out or relieved an amount sufficient to accommodate the flange 18 of the runner 12 for the "worst case" that can be encountered during the installation/removal of the panel 10 from the grid system.

In installation, the elongated tabs 14 are first inserted into the grid runner slots 22. The opposite end of the ceiling panel is then lifted upward past the lower flange of the opposite runner, and the ceiling panel is then shifted back toward the opposite runner so that the panel drops down with the tabs 14 resting on the flange 18 of the main runner, and the shorter tabs 16 engaging the flange 18 of the opposite main runner. As noted above, the notch 20 in the tabs 14 will help to ensure the proper end-to-end spacing of adjacent panels.

For removal, the end of the panel with the elongated tabs 14 is lifted and shifted towards its associated main runner, again as can be seen in FIG. 3. The tabs 16 on the opposite end of the panel will then disengage from the opposite runner, and the panel can then be dropped down and moved backwards so as to disengage the elongated tabs 14 from the cutouts 22 in the main runner, thus freeing the panel from the grid.

A ceiling system in accordance with the disclosure has many features and advantages. The panels may be installed into the suspension grid without any extra clips, brackets, springs, or special tools. The panels are self-spacing and easy to install and remove, requiring only a single person. Side-to-side alignment is maintained by the cooperation of the elongated tabs and the projections in the cutouts in the main runner on one end of the panel and by the cooperating flange and cutaway/tabs on the other end, while end-to-end alignment is provided by the notches in the elongated tabs seating on the lower flanges of the grid. Further, in contrast to many prior art hook-in ceiling systems, the system of the present disclosure does not have to be assembled or disassembled progressively. That is, the configuration of the system is such that the entire grid can be assembled before any panels are installed in the grid, and the panels can be installed in or removed from the assembled grid at any location and in any order.

While the panel has been described as being formed of a single sheet of metal that provides the suspension structure that cooperates with the grid, it should be understood that the suspension and alignment features of the panel (e.g., the elongated and short tabs and the flange and cooperating cutaway) may also be utilized with composite ceiling panels. For example, the suspension and alignment features may be part of a frame or partial frame associated with or otherwise inserted into a separately made tile or panel.

The invention claimed is:

1. A suspended ceiling system comprising at least first and second parallel inverted tee-runners, each tee-runner comprising a horizontal flange and a vertical web, the vertical web having at least two spaced openings therein; and At least one ceiling panel, having opposed side walls and opposed end walls with a pair of first tabs formed at one end of the ceiling panel and a pair of second tabs formed at the opposite end of the panel, the first tabs being relatively longer than the second tabs and having a length sufficient so that each first tab extends through one of the spaced openings in the web of the first inverted tee-runner and rests on the flange of the first tee-runner with the second tabs being supported by the flange of the second tee-runner.

2. The suspended ceiling system of claim 1 wherein the first and second tabs are formed in the side walls of the panel and the side walls are relieved adjacent the first tabs.

3. The suspended ceiling system of claim 1 in which the openings in the web of the tee-runners and the first tabs of the ceiling panel are complementarily-shaped so as to limit the lateral positioning of the panel relative to the tee-runner and provide side-to-side alignment of adjacent panels.

4. The suspended ceiling system of claim 2 in which the openings in the web of the tee-runners and the first tabs of the ceiling panel are complementarily-shaped so as to limit the lateral positioning of the panel relative to the tee-runner and provide side-to-side alignment of adjacent panels.

5. The suspended ceiling system of claim 1 in which one or both of the pairs of the first tabs and the second tabs of the ceiling panel are formed with a shoulder for engaging an edge of the flange of the associated tee-runner to provide end-to-end alignment of adjacent panels.

6. The suspended ceiling system of claim 2 in which one or both of the pairs of the first tabs and the second tabs of the ceiling panel are formed with a shoulder for engaging an edge of the flange of the associated tee-runner to provide end-to-end alignment of adjacent panels.

7. The suspended ceiling system of claim 3 in which one or both of the pairs of the first tabs and the second tabs of the ceiling panel are formed with a shoulder for engaging an edge of the flange of the associated tee-runner to provide end-to-end alignment of adjacent panels.

8. The suspended ceiling system of claim 1 wherein one end wall of the ceiling panel is formed with an outwardly-extending flange and the other end wall is relieved to receive the outwardly-extending flange of an adjacent panel.

9. The suspended ceiling system of claim 2 wherein one end wall of the ceiling panel is formed with an outwardly-extending flange and the other end wall is relieved to receive the outwardly-extending flange of an adjacent panel.

10. The suspended ceiling system of claim 3 wherein one end wall of the ceiling panel is formed with an outwardly-extending flange and the other end wall is relieved to receive the outwardly-extending flange of an adjacent panel.

11. The suspended ceiling system of claim 5 wherein one end wall of the ceiling panel is formed with an outwardly-extending flange and the other end wall is relieved to receive the outwardly-extending flange of an adjacent panel.

12. The suspended ceiling system of claim 1 wherein one of the side walls and one of the end walls of each ceiling panel is provided with a resilient material for inhibiting vibration between adjacent panels.

13. The suspended ceiling system of claim 2 wherein one of the side walls and one of the end walls of each ceiling panel is provided with a resilient material for inhibiting vibration between adjacent panels.

14. The suspended ceiling system of claim 3 wherein one of the side walls and one of the end walls of each ceiling panel is provided with a resilient material for inhibiting vibration between adjacent panels.

15. The suspended ceiling system of claim 5 wherein one of the side walls and one of the end walls of each ceiling panel is provided with a resilient material for inhibiting vibration between adjacent panels.

16. The suspended ceiling system of claim 8 wherein one of the side walls and one of the end walls of each ceiling panel is provided with a resilient material for inhibiting vibration between adjacent panels.

* * * * *